US005813843A

United States Patent [19]

Suefuji et al.

[11] Patent Number: 5,813,843

[45] Date of Patent: Sep. 29, 1998

[54] SCROLL-TYPE FLUIDIC MACHINE HAVING A SLIDER FOR AXIAL THRUST AND ROTATION PREVENTION

[75] Inventors: Kazutaka Suefuji, Kanagawa-ken; Yuji Komai, Tokyo; Yoshio Kobayashi, Kanagawa-ken; Hiroyuki Mihara, Kanagawa-ken; Toshitugu Suzuki, Kanagawa-ken, all of Japan

[73] Assignee: Tokico Ltd., Kanagawa-Ken, Japan

[21] Appl. No.: 873,171

[22] Filed: Jun. 11, 1997

Related U.S. Application Data

[62] Division of Ser. No. 652,386, May 23, 1996, abandoned.

[30] Foreign Application Priority Data

May 24, 1995 [JP] Japan ..... 7-149445

[51] Int. Cl.[6] ..... F01C 1/04; F16D 3/04

[52] U.S. Cl. ..... 418/55.3; 464/102

[58] Field of Search ..... 418/55.3; 464/102, 464/104, 105

[56] References Cited

U.S. PATENT DOCUMENTS 4,325,683 4/1982 Miyazawa ..... 418/55.3

4,406,600 9/1983 Terauchi et al. ..... 418/55.3

FOREIGN PATENT DOCUMENTS 58-85387 5/1983 Japan ..... 418/55.3

63-227981 9/1988 Japan ..... 418/55.3

1-227885 9/1989 Japan ..... 418/55.3

6-42473 2/1994 Japan ..... 418/55.3

*Primary Examiner*—John J. Vrablik

*Attorney, Agent, or Firm*—Wenderoth, Lind & Ponack, L.L.P.

[57] ABSTRACT

In the scroll-type fluidic machine according to the present invention, a slider is slidably disposed between a casing and a rear surface of a orbiting scroll member, and a sliding movement of the slider relative to the casing and the orbiting scroll member is regulated to two (X-axis and Y-axis) directions by means of X-axis and Y-axis guides. Balls received in through holes of the slider are formed from material harder than that of the slider and are rollingly contacted with a slide surface of a flange portion of the casing and a slide surface of a rear plate of the orbiting scroll member. The through holes are filled with grease. The balls are adapted to roll smoothly, thereby greatly decreasing frictional resistance between surfaces of the slider and the slide surfaces of the casing and the orbiting scroll member.

4 Claims, 9 Drawing Sheets

SCROLL-TYPE FLUIDIC MACHINE HAVING A SLIDER FOR AXIAL THRUST AND ROTATION PREVENTION

This is a divisional application of Ser. No. 08/652,386, filed May 23, 1996, now abandoned.

BACKGROUND OF THE INVENTION

1. Field of the Invention

The present invention relates to a fluidic machine of a scroll type (referred to as "scroll-type fluidic machine" hereinafter) suitable to be used with an air compressor, a vacuum pump and the like, for example, and more particularly, the invention relates to a scroll-type fluidic machine of an oil free type.

2. Related Background Art

There has been proposed a scroll-type fluidic machine generally comprising a casing, a fixed scroll member integrally attached to the casing, a drive shaft having a proximal end rotatably supported by the casing and a distal end formed as a crank, a orbiting scroll member rotatably attached to the crank of the drive shaft so that a plurality of compression chambers are defined between the orbiting scroll member and the fixed scroll member, and a rotation preventing mechanism for preventing rotation of the orbiting scroll member.

In such a conventional scroll-type fluidic machine, the orbiting scroll member is revolved relative to the fixed scroll member with predetermined eccentricity by rotating the drive shaft from outside, with the result that (atmospheric) air is sucked through a suction opening formed in an outer peripheral surface of the fixed scroll member. Then, the air is successively compressed in the compression chambers defined between a scroll wrap of the fixed scroll member and a scroll wrap of the orbiting scroll member. The compressed air is then discharged through a discharge opening formed in a central portion of the fixed scroll member.

In scroll-type fluidic machines of an oil free type, it is known to use a plurality of auxiliary cranks in order to prevent the rotation of the orbiting scroll member. That is to say, a plurality of auxiliary cranks are provided around a revolution bearing of the orbiting scroll member between the casing and a rear side of the orbiting scroll member to prevent the rotation of the orbiting scroll member. In case of such rotation preventing mechanisms having a plurality of auxiliary cranks, grease is applied to rotating parts of the auxiliary cranks to maintain the lubrication of the auxiliary cranks.

There has also been proposed another technique in which an Oldham's coupling is used as a rotation preventing mechanism of a scroll-type fluidic machine and the Oldham's coupling functions only to prevent the rotation of a orbiting scroll member. Such a technique is disclosed in Japanese Patent Publication No. 6-37875 (1994), for example. Further, U.S. Pat. No. 3,994,635 discloses an Oldham's coupling having both a function for preventing rotation of a orbiting scroll member and a function for bearing or supporting a thrust (axial) load of the orbiting scroll member. In such rotation preventing mechanisms constituted by the Oldham's couplings, lubricant is always supplied to sliding parts of the Oldham's coupling to maintain the lubrication of the Oldham's coupling.

As disclosed in Japanese Patent Publication No. 5-67761 (1993), for example, it is also known to provide a further rotation preventing mechanism of ball coupling type comprising a number of balls having both a function for preventing rotation of a orbiting scroll member and a function for acting as a thrust bearing for supporting a thrust load of the orbiting scroll member, and two ring-shaped plates having the same number of circular guide holes.

In the firstly mentioned conventional scroll-type fluidic machine, since the plurality of auxiliary cranks are used as the rotation preventing mechanism, it is necessary to coincide the eccentricity of the crank of the drive shaft with those of the auxiliary cranks, thereby requiring a highly accurate manufacturing technique.

Even if the correct eccentricity for all of the various cranks is designed, it is difficult to maintain the balance between the crank of the drive shaft and the auxiliary cranks due to the influence of the centrifugal force generated by the revolution of the orbiting scroll member, thereby often generating vibration. Thus, the actual designing and manufacturing of the rotation preventing mechanism is very difficult, and the structure or construction becomes complicated and the number of parts is increased.

In the operation of the above-mentioned conventional scroll-type fluidic machine, since the compression chambers defined between the fixed scroll member and the orbiting scroll member are subjected to high pressure, the orbiting scroll member is urged or biased in an axial direction. The axial urging force acts on the crank of the drive shaft and the auxiliary cranks as loads to increase rotational friction of the crank of the drive shaft and the auxiliary cranks, thereby worsening the driving efficiency and causing abnormal wear and/or frictional heat of the crank of the drive shaft and the auxiliary cranks.

In the above-mentioned conventional rotation preventing mechanism using the Oldham's coupling having the rotation preventing function alone (see Japanese Patent Publication No. 6-37875), since thrust bearings for supporting the axial load of the orbiting scroll member must be provided independently from the Oldham's coupling, the entire machine becomes bulky. On the other hand, in the Oldham's coupling having both the function for preventing the rotation of the orbiting scroll member and the function as the thrust bearing (see U.S. Pat. No. 3,994,635), since the axial urging force from the orbiting scroll member directly acts on both surfaces of the Oldham's coupling, the Oldham's coupling is apt to be worn during the sliding movement of the coupling, thereby worsening the compressing ability or the like.

In the rotation preventing mechanism having such an Oldham's coupling, although the coupling has a relatively simple structure and can easily be designed and manufactured, since the lubricant must always be supplied to the sliding parts of the Oldham's coupling (while such rotation preventing mechanism can be applied to a scroll-type fluidic machine to which lubricant is supplied), it is difficult to apply such rotation preventing mechanism to the scroll-type fluidic machine of the oil free type.

Finally, in the conventional rotation preventing mechanism having the ball coupling (see Japanese Patent Publication No. 5-67761), it is difficult not only to effect the positioning of the orbiting scroll member in the revolving direction and adjust a radial gap with high accuracy but also to prevent noise generated from the balls.

SUMMARY OF THE INVENTION

The present invention aims to eliminate the above-mentioned drawbacks in conventional machines, and an object of the present invention is to provide an oil free scroll-type fluidic machine in which a rotation preventing mechanism having an Oldham's coupling can be applied and which can effectively prevent the wear and damage of the Oldham's coupling during a compression stroke, can be made compact and can improve endurance and service life.

To eliminate the above-mentioned drawbacks, the present invention is applied to a scroll-type fluidic machine comprising a casing, a fixed scroll member integrally mounted on the casing, a drive shaft having a proximal end rotatably supported by the casing and a distal end formed as a crank, a orbiting scroll member rotatably attached to the crank of the drive shaft so that a plurality of compression chambers are defined between the orbiting scroll member and the fixed scroll member, and a rotation preventing mechanism for preventing rotation of the orbiting scroll member.

In the scroll-type fluidic machine according to the present invention, the rotation preventing mechanism is constituted by a slider disposed between the casing and the orbiting scroll member and slidable relative to the casing and the orbiting scroll member, respectively, in two directions perpendicular to each other, which slider is provided with a plurality of through holes spaced apart from each other in the circumferential direction of the orbiting scroll member and extending in an axial direction. The through holes are adapted to receive rolling elements rollingly contacted with the casing and a rear surface of the orbiting scroll member to support an axial load from the orbiting scroll member.

In this case, it is preferable that the through holes of the slider are filled with lubricant for maintaining the rolling elements in a lubricated condition.

Preferably, a passage portion for passing cooling air is formed in the slider at a position spaced apart from the through holes in the circumferential direction of the orbiting scroll member.

With the arrangement as mentioned above, when the slider is slidingly shifted in either of two directions, since the rolling elements disposed in the slider are slidingly contacted with the casing and the rear surface of the orbiting scroll member, it is possible to reduce the frictional resistance which acts on the slider from the casing and the orbiting scroll member. Since the axial load from the orbiting scroll member is supported by the slider and the rolling elements disposed in the slider, it is possible to prevent the whole axial load from acting on the slider only.

Further, when the through holes of the slider are filled with the lubricant for maintaining the rolling elements in the lubricated condition, it is possible to reduce the frictional resistance generated when the rolling elements are rolling on the casing and the rear surface of the orbiting scroll member, with the result that the slider can slide more smoothly and wear and damage generated during the rolling movement of the rolling elements can surely be prevented.

By providing the passage portion for passing the cooling air in the slider at the position spaced apart from the through holes in the circumferential direction of the orbiting scroll member, the cooling air can also be supplied to the drive shaft and the rear surface of the orbiting scroll member, with the result that the frictional heat generated on the slider and the rolling elements during the sliding movement of the slider can positively be removed and, at the same time, the orbiting scroll member and the drive shaft can be cooled.

DETAILED DESCRIPTION OF THE PREFERRED EMBODIMENTS

Figure 1:
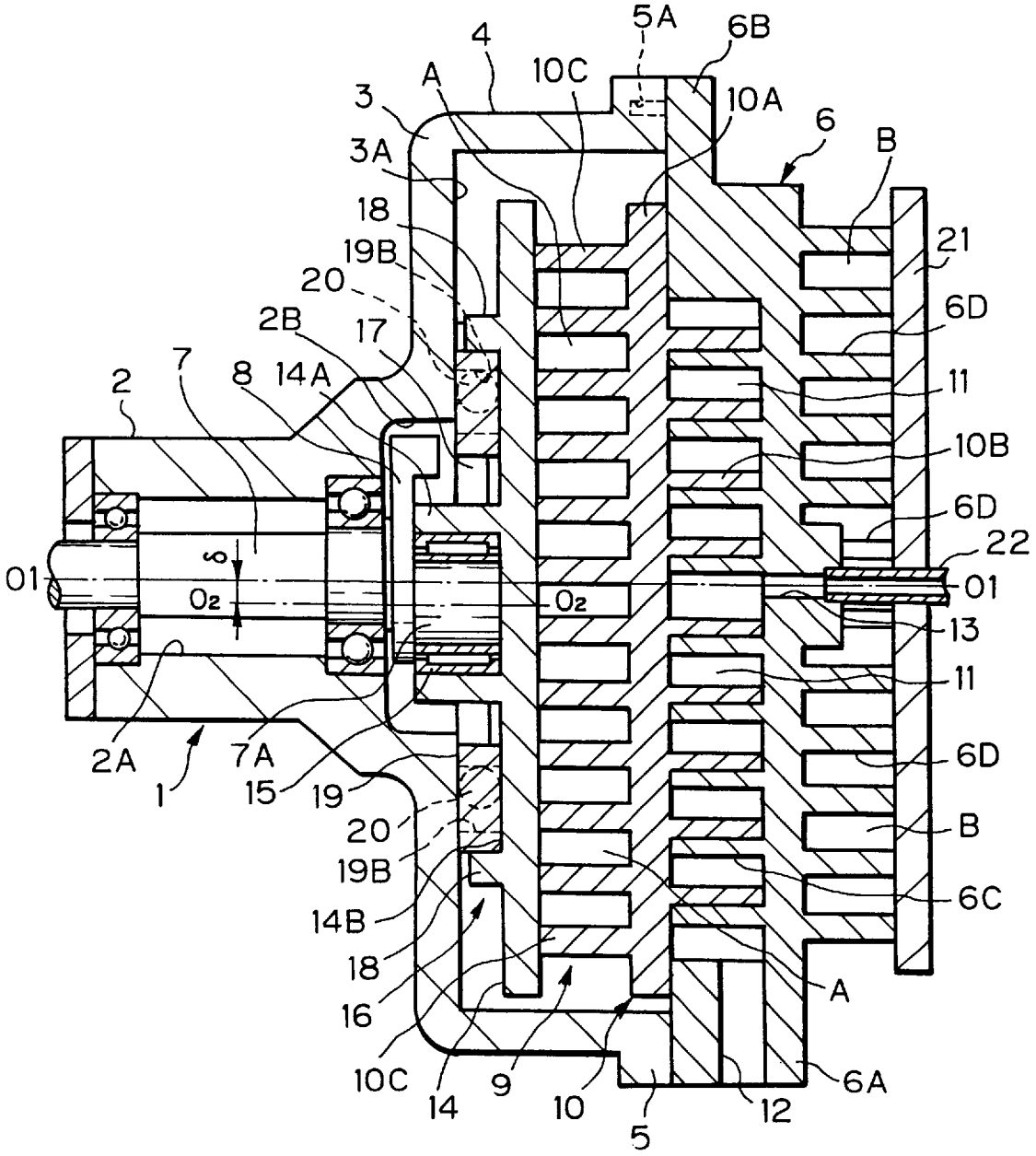
FIG. 1 is an elevational sectional view of a scroll-type air compressor according to a first embodiment of the present invention.

The present invention will now be explained in connection with embodiments thereof with reference to FIGS. 1 to 14. A scroll-type fluidic machine according to the present invention will be described taking a scroll-type air compressor of oil free type, as an example.

A first embodiment of the present invention is shown in FIGS. 1 to 4.

In FIGS. 1 to 4, the scroll-type air compressor comprises a stepped cylindrical casing 1 forming an outer frame of the compressor and having a small diameter cylindrical bearing portion 2, an annular flange portion 3 extending from a proximal end of the bearing portion 2 radially outwardly, a cylindrical large diameter portion 4 extending from a peripheral end of the flange portion 3 in an axial direction, and an annular abutment portion 5 extending from a free end of the large diameter portion 4 radially outwardly.

The bearing portion 2 of the casing 1 is provided with an elongated small diameter bore portion 2A into which a drive shaft 7 (described later) is inserted, and a short large diameter bore portion 2B which is open to the large diameter portion 4 and within which a counterweight 8 (described later) and a boss portion 14A of an orbiting scroll member 9 (described later) are contained. The flange portion 3 of the casing 1 has an inner slide surface 3A on which a slider 19 (described later) is slidingly moved. X-axis guides 17 (described alter) are formed on the slide surface 3A.

Figure 2:
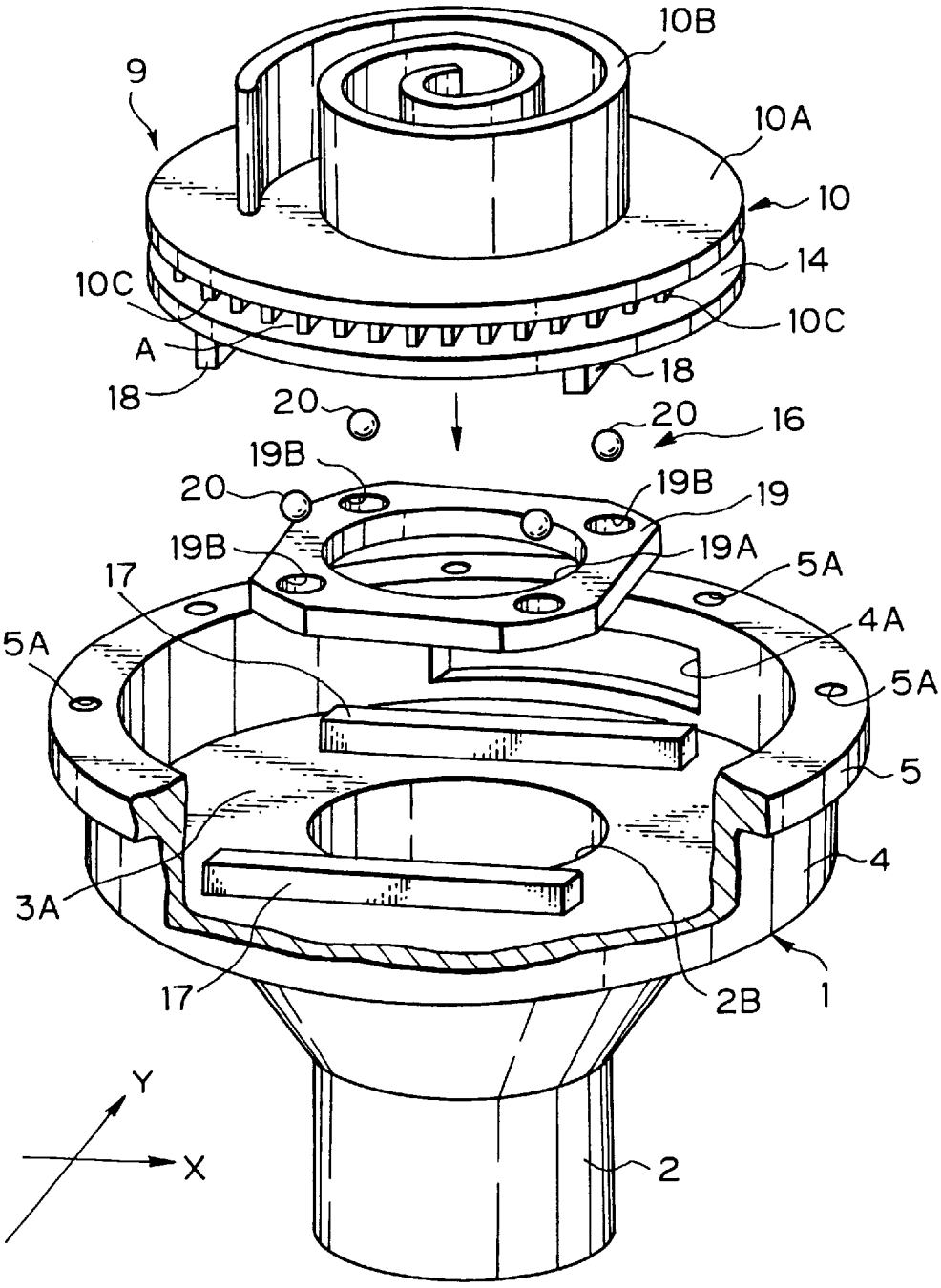
FIG. 2 is an exploded perspective view showing a casing, an orbiting scroll member and a rotation preventing mechanism of the compressor of FIG. 1.

As shown in FIG. 2, the large diameter portion 4 of the casing 1 is provided with a cooling air inlet opening 4A for directing cooling air into the casing 1 and a cooling air discharge opening (not shown) diametrically opposed to the cooling air inlet opening 4A, and the abutment portion 5 of the casing 1 is provided with threaded bolt holes 5A with which an attachment flange portion 6B of a fixed scroll member 6 (described later) is attached to the abutment portion by bolts.

The fixed scroll member 6 is secured to a free (tip) end of the casing 1 and comprises a circular end plate 6A disposed in such a manner that a center of the end plate coincides with the axis O1—O1 of the drive shaft 7, the above-mentioned attachment flange portion 6B protruding from an outer periphery of the end plate 6A and secured to the abutment portion 5 of the casing 1 by the bolts (not shown), a scroll wrap 6C protruding from a front surface of the end plate 6A in the axial direction and having a wrap start inner end and a wrap finish outer end, and a plurality of radiator plates 6D formed on a rear surface of the end plate 6A in parallel.

The drive shaft 7 is rotatably supported within the small diameter bore portion 2A of the bearing portion 2 (of the casing 1) via bearings. A tip end (distal end) of the drive shaft 7 terminates as a crank 7A received in the large diameter bore portion 2B of the bearing portion 2, and the axis O2—O2 of the crank 7A is offset from the axis O1—O1 of the drive shaft 7 by a predetermined amount δ. A proximal end of the drive shaft 7 protruding out of the casing 1 is connected to a drive source (not shown) so that, by rotating the drive shaft by means of the drive source, the orbiting scroll member 9 (described later) is revolved via the crank 7A.

The counterweight 8 is secured to a proximal end of the crank 7A and is disposed within the large diameter bore portion 2B of the bearing portion 2 to provide rotational balance of the entire drive shaft 7.

The orbiting scroll member 9 is revolvingly received within the casing 1 in a confronting relation to the fixed scroll member 6. The orbiting scroll member 9 is constituted by a revolving scroll body 10 (described later), and a generally circular rear surface plate 14 integrally connected to a rear surface of the revolving scroll body 10.

As shown in FIG. 2, the revolving scroll body 10 comprises a circular end plate 10A, a scroll wrap 10B protruding from a front surface of the end plate 10A in the axial direction and having a wrap start inner end and a wrap finish outer end, and a plurality of radiator plates 10C formed on a rear surface of the end plate 10A in parallel. As shown in FIG. 1, the scroll wrap 10B of the revolving scroll body 10 is disposed in an overlapped relation to the scroll wrap 6C of the fixed scroll member 6 with a predetermined angular offset (for example, 180 degrees) so that a plurality of compression chambers 11 are defined between the scroll wraps 6C and 10B.

In an operation of the scroll air compressor, air is sucked into the compression chambers 11 successively through a suction opening 12 formed in the outer peripheral surface of the fixed scroll member 6. While the orbiting scroll member 9 is being revolved, the air is gradually compressed in each compression chamber 11, and, eventually, the compressed air is discharged outside through a discharge opening 13 formed in the fixed scroll member 6 at its central portion from the compression chamber 11 when the latter reaches the center of the fixed scroll member.

Rear plate 14 provided on a rear side of the revolving scroll body 10 is formed from a circular plate having a diameter substantially the same as that of the end plate 10A of the revolving scroll body 10, and the above-mentioned boss portion 14A extending in the axial direction is formed on a rear surface of the rear plate 14 at its center. The rear plate 14 is secured to free ends (rear ends) of the radiator plates 10C of the revolving scroll body 10 by bolts (not shown) so that a plurality of cooling passages A are defined between the radiator plates 10C. Thus, the rear side of the end plate 10A of the revolving scroll body 10 can be cooled efficiently by cooling air introduced from the outside. At a rear surface of the rear plate 14, a slide surface 14B is defined between Y-axis guides 18 (described later), and slider 19 can slide on the slide surface 14B.

The boss portion 14A of the rear plate 14 protrudes axially toward the bearing portion 2 of the casing 1 and is rotatably attached to the crank 7A of the drive shaft 7 through a revolution bearing 15.

As shown in FIGS. 1 to 4, a rotation preventing mechanism 16 for preventing rotation of the orbiting scroll member 9 includes the above-mentioned X-axis guides 17, Y-axis guides 18, the above-mentioned slider 19, and balls 20 so that, by slidingly shifting the slider 19 in X-axis and Y-axis directions, the rotation of the orbiting scroll member 9 integrally formed with the Y-axis guides 18 is prevented and circular motion (revolving motion) having a revolving radius of the predetermined value δ is given to the orbiting scroll member 9. That is, the rotation preventing mechanism is constituted by a so-called Oldham's coupling.

The X-axis guides 17 are integrally formed with the slide surface 3A of the flange portion 3 (of the casing 1), and, as shown in FIG. 2, the X-axis guides 17 are formed from elongated prismatic members extending in the X-axis direction and are spaced apart from each other in the Y-axis direction by a predetermined distance across the large diameter bore portion 2B of the drive shaft 7. The slider 19 is mounted between the X-axis guides 17 so that lateral edges 19C (FIG. 3) of the slider 19 are slidingly contacted with the X-axis guides 17, thereby regulating or preventing the slider 19 from slidingly shifting in the Y-axis direction with respect to the casing 1.

The Y-axis guides 18 are integrally formed with the slide surface 14B of the rear plate 14 (of the orbiting scroll member 9). Similar to the X-axis guides 17, the Y-axis guides 18 are formed from elongated prismatic members extending in the Y-axis direction and are spaced apart from each other in the X-axis direction by a predetermined distance across the boss portion 14A of the rear plate 14. The slider 19 is mounted between the Y-axis guides 18 so that lateral edges 19D (FIG. 3) of the slider 19 are slidingly contacted with the Y-axis guides 18, thereby regulating or preventing the slider 19 from slidingly shifting in the X-axis direction with respect to the orbiting scroll member 9.

Figure 3:
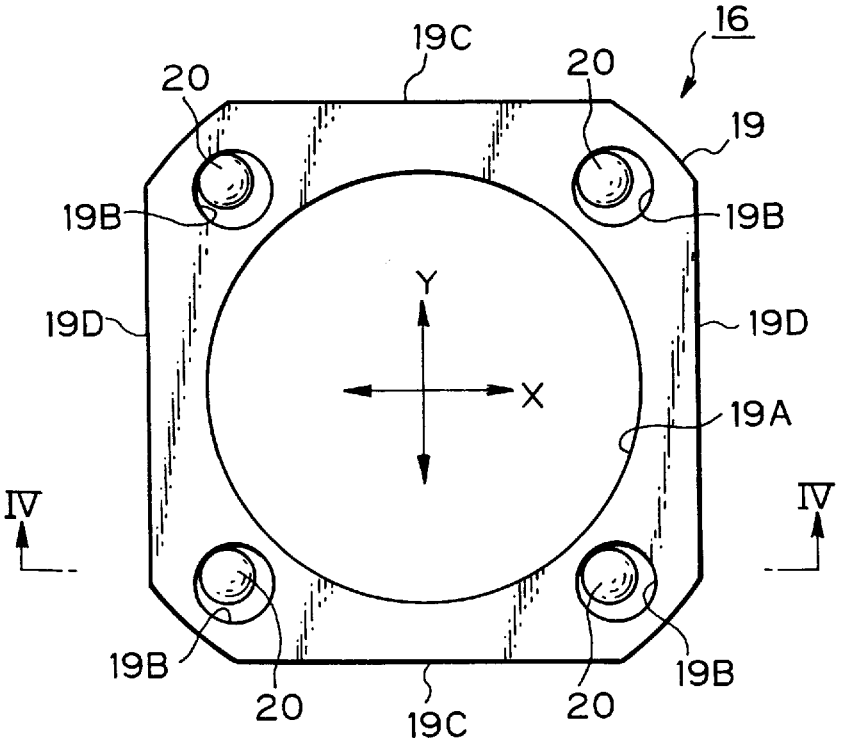
FIG. 3 is an enlarged plan view of a slider and balls of the compressor of FIG. 1.

As shown in FIG. 3, the slider 19 is slidably disposed between the flange portion 3 of the casing 1 and the rear plate 14 of the orbiting scroll member 9 and may be formed from a generally square metal plate having high strength. The slider is provided at its central portion with a circular opening 19A through which the boss portion 14A of the rear plate 14 can pass and which serves to prevent the slider 19 from interfering with the boss portion 14A when the slider 19 slides. Further, as shown in FIGS. 2 and 3, the slider 19 is provided at its four corners with four through holes 19B, respectively. These through holes are disposed around the central circular opening 19A (encircling the boss portion 14A of the rear plate 14) and are spaced apart from each other in a circumferential direction of the circular opening. The balls 20 (described later) are received within the corresponding through holes 19B together with grease.

As shown in FIG. 3, the lateral edges 19C of the slider 19 opposed to each other in the Y-axis direction act as slide edge surfaces for the X-axis guides 17, and the lateral edges 19D opposed to each other in the X-axis direction act as slide edge surfaces for the Y-axis guides 18. On the other hand, front and rear surfaces of the slider 19 act as slide surfaces for the slide surface 14B of the rear plate 14 and the slide surface 3A of the flange portion 3, respectively, and further act as bearing surfaces for supporting axial forces generated by the compression process of the orbiting scroll member 9.

The sliding movement of the slider with respect to the slide surface 3A of the flange portion 3 is regulated to the X-axis direction by the X-axis guides 17, and the sliding movement of the slider with respect to the slide surface 14B of the rear plate 14 is regulated to the Y-axis direction by the Y-axis guides 18.

Figure 4:
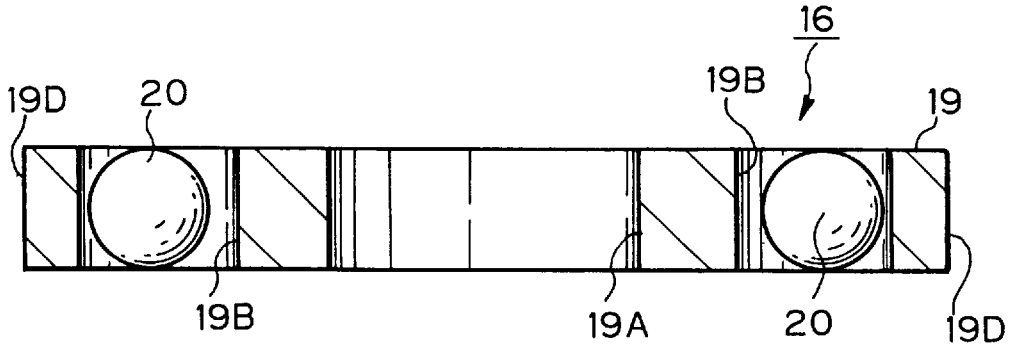
FIG. 4 is an enlarged sectional view taken along the line IV—IV in FIG. 3.

The balls (rolling elements) 20 received within the respective through holes 19B of the slider 19 are formed from metallic material harder than that of the slider 19 and each has a diameter substantially the same as the thickness of the slider 19, as shown in FIG. 4. The through holes 19B of the slider 19 containing the respective balls 20 therein are substantially sealed at both ends by the slide surface 3A of the flange portion 3 and the slide surface 14B of the rear plate 14, as shown in FIG. 1.

Since the through holes 19B of the slider 19 are filled with the grease (not shown) (together with the balls), when the front and rear surfaces of the slider 19 slide on the slide surfaces 3A, 14B, due to the presence of the grease, the balls 20 can smoothly be rolled in the through holes 19B of the slider, while being maintained in the lubricated condition. The balls 20 can bear or support (together with the front and rear surfaces of the slider 19) the axial forces generated by the movement of the orbiting scroll member 9.

A cover 21 is provided at a front side of the fixed scroll member 6. More particularly, the cover 21 is secured to free ends of the radiator plates 6D of the fixed scroll member 6 by bolts (not shown) so that a plurality of cooling air passages B are defined between the radiator plates 6D. Thus, the end plate 6A and the scroll wrap 6C of the fixed scroll member 6 can be cooled effectively by the cooling air introduced from the outside.

A discharge pipe 22 has a proximal end connected to the discharge opening 13 formed in the central portion of the fixed scroll member 6 and a distal (free) end passing through the cover 21 and connected to an air tank and the like.

Next, an operation of the scroll-type air compressor according to the illustrated embodiment having the above-mentioned construction will be explained.

First of all, when the orbiting scroll member 9 is revolved by rotating the drive shaft 7 by means of an electric motor, the compression chambers 11 defined between the scroll wrap 6C of the fixed scroll member 6 and the scroll wrap 10B (of the revolving scroll body 10) of the orbiting scroll member 9 are continuously contracted (i.e. reduction in volume). As a result, the air sucked through the suction opening 12 of the fixed scroll member 6 is successively compressed in the compression chambers 11. The compressed air is then successively discharged from the compression chambers through the discharge opening 13 of the fixed scroll member 6 and then is accumulated in the air tank through the discharge pipe 22.

While the orbiting scroll member 9 is being revolved in this way, the rotation of the orbiting scroll member 9 is prevented by the rotation preventing mechanism comprised of the X-axis guides 17, Y-axis guides 18, slider 19 and balls 20, with the result that the orbiting scroll member 9 is revolved (circular motion or revolving motion) around the drive shaft 7 with the predetermined eccentricity δ.

That is to say, while the orbiting scroll member 9 is being revolved with respect to the fixed scroll member 6, the slider 19 is slid in the X-axis direction (FIG. 2) with respect to the casing 1, while it is regulated for sliding movement in the Y-axis direction by the sliding of the opposed lateral edges 19C along the X-axis guides 17. Further, the slider is slid in the Y-axis direction with respect to the orbiting scroll member 9, while it is regulated for sliding movement in the X-axis direction by the sliding of the opposed lateral edges 19D along the Y-axis guides 18. Meanwhile, the front and rear surfaces of the slider 19 are slid on the slide surface 3A of the flange portion 3 and the slide surface 14B of the rear plate 14 to support the axial load, together with the balls 20.

Since the balls 20 are received in the respective through holes 19B of the slider 19 and are rollingly contacted with the slide surfaces 3A, 14B and the through holes 19B are filled with the grease, the slider 19 can be slid on the slide surfaces 3A, 14B while rolling the balls 20 smoothly.

Consequently, the frictional resistance between the front and rear surfaces of the slider 19 and the slide surfaces 3A, 14B can be reduced greatly, and the wear which may be caused during the sliding movement of the slider 19 can be suppressed effectively, thereby sliding the slider 19 between the slide surfaces 3A and 14B smoothly.

After the sliding movement of the slider 19 is repeated, even when the surfaces of the slider are worn slightly, since the balls 20 are harder than the slider 19, the balls 20 alone are contacted with the slide surfaces 3A, 14B, thereby surely preventing the surfaces of the slider 19 from being further worn.

Further, since the front and rear surfaces of the slider 19 cooperate with the balls 20 to support the axial load (pressing forces) generated by the compression process of the orbiting scroll member 9, the wear and damage of the slider 19 can be further prevented effectively.

Since the through holes 19B of the slider 19 are sealed between the slide surfaces 3A and 14B, the grease in the holes can effectively be prevented from leaking outside, and rolling noise of the balls 20 in the through holes 19B can also be prevented from leaking outside, thereby reducing the noise of the compressor effectively.

As mentioned above, in the illustrated embodiment, the slider 19 is slidably disposed between the casing 1 and the rear surface of the orbiting scroll member 9; the sliding movement of the slider 19 is regulated to two directions (X-axis and Y-axis directions) relative to the casing and the orbiting scroll member, respectively, by the X-axis guides 17 and the Y-axis guides 18; the balls 20 together with the grease are contained within the through holes 19B of the slider 19 so that the balls are rollingly contacted with the slide surface 3A of the flange portion 3 and the slide surface 14B of the rear plate 14; and the balls 20 are made of material harder than that of the slider 19.

As a result, by rolling the balls 20 smoothly, the frictional resistance between the front and rear surfaces of the slider 19 and the slide surfaces 3A, 14B can be reduced greatly, and the wear between the slider 19 and the slide surfaces 3A, 14B can also be prevented effectively. Further, since the front and rear surfaces of the slider 19 can support the axial forces from the orbiting scroll member 9 in cooperation with the balls 20, the wear and damage of the slider 19 can be further prevented effectively.

Therefore, in accordance with the present invention, by rolling the balls 20 on the slide surfaces 3A, 14B, the endurance of the slider 19 can surely be improved. As a result, the service life of the scroll-type air compressor can be extended and the performance of the compressor can surely be improved, thereby maintaining the stable compressing ability for a long time.

Further, a thrust bearing for supporting the axial load (pressing forces) can be formed compactly by the slider 19 and the balls 20, thereby making the entire compressor compact.

Even if the lubricant such as oil is not supplied between the slider 19 and the slide surfaces 3A, 14B and between the slider 19 and the X-axis and Y-axis guides 17, 18, the slider 19 can be slid smoothly between the casing 1 and the rear surface of the orbiting scroll member 9 by means of the balls 20. Thus, the scroll-type air compressor can be operated smoothly as a compressor of the oil free type.

Figure 5:
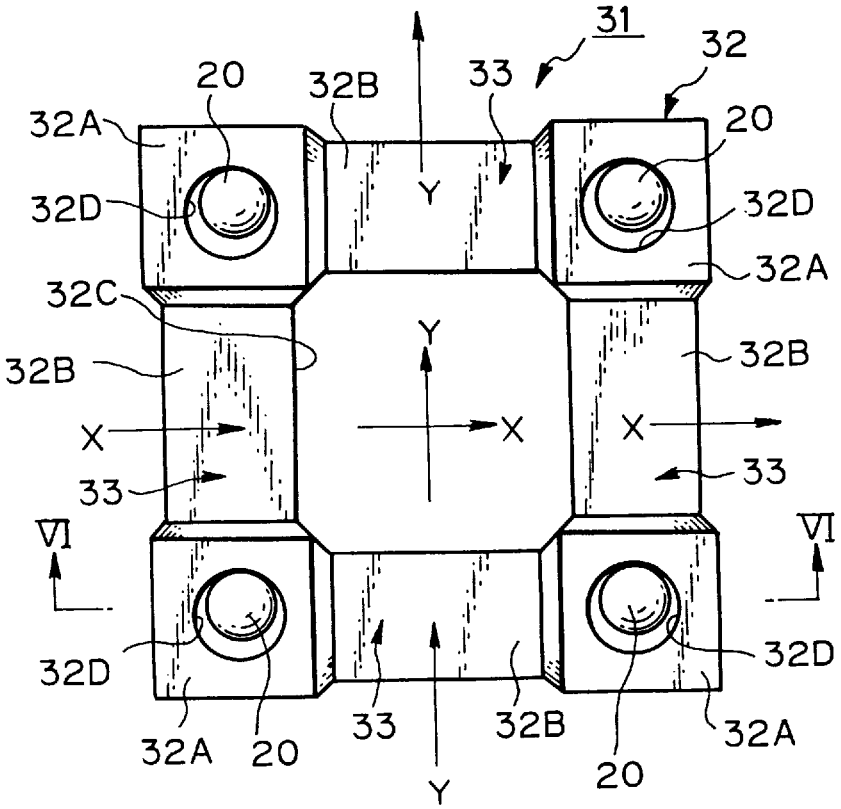
FIG. 5 is a plan view similar to FIG. 3, but showing a second embodiment of the present invention.
Figure 6:
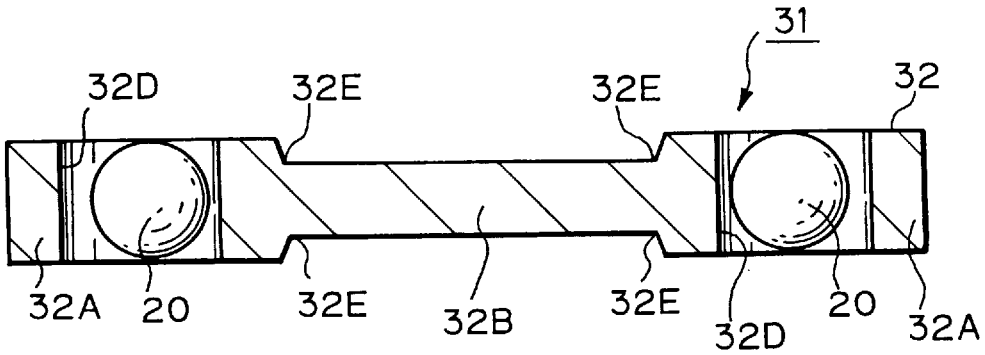
FIG. 6 is an enlarged sectional view taken along the line VI—VI in FIG. 5.

Next, a second embodiment of the present invention will be explained with reference to FIGS. 5 and 6. In this second embodiment, the same elements as those in the first embodiment are designated by the same reference numerals, and explanation thereof will be omitted. Incidentally, the feature of the second embodiment is that a slider 32 of a rotation preventing mechanism 31 slidably disposed between the casing 1 and the orbiting scroll member 9 comprises square thick portions 32A and elongated thin portions 32B interconnecting the thick portions, and passage portions 33 for passing cooling air are defined between the thin portions 32B and the slide surface 3A of the flange portion 3 and between the thin portions 32B and the slide surface 14B of the rear plate 14.

Although the slider 32 is formed similar to the slider 19 of the first embodiment (i.e. substantially a square configuration), the slider 32 has a square central opening 32C. And, as shown in FIGS. 5 and 6, the slider 32 is constituted by the thick portions 32A disposed at four corners of the square, and the thin portions 32B interconnecting the thick portions. Outer lateral edges of each thick portion 32A act as slide edge surfaces cooperating with the X-axis and Y-axis guides 17, 18, respectively.

Front and rear surfaces of the thick portions 32A act as slide surfaces associated with the slide surfaces 3A, 14B respectively, and are slid on the slide surfaces 3A, 14B and move together with the balls 20 received within four through holes 32D formed in the thick portions 32A. The thick portions 32A and the thin portions 32B of the slider 32 are interconnected via tapered inclination surfaces 32E so that, when the slider 32 is slidingly contacted with the slide surfaces 3A, 14B, a plurality of passage portions 33 for passing cooling air are formed between front and rear surfaces of the thin portions 32B and the slide surfaces 3A, 14B.

Thus, also in this embodiment, the technical advantage substantially the same as that of the first embodiment can be obtained. Particularly, in the second embodiment, since the cooling passage portions 33 are defined between the slider 32 and the slide surfaces 3A, 14B, as shown in FIG. 5, the cooling air can flow in the X-axis and Y-axis directions, with the result that, when the slider 32 is slid, the frictional heat generated between the slide surfaces 3A, 14B and the side surfaces of the X-axis and Y-axis guides 17, 18 can effectively be removed, thereby enhancing the endurance of the slider 32 efficiently.

At the same time, the revolution bearing 15 in the boss portion 14A can be cooled by the cooling air, with the result that damage in a short time of the revolution bearing 15 due to the frictional heat generated by the rotation of the drive shaft 7 can be prevented effectively, thereby enhancing the endurance and service life of the entire compressor.

Figure 7:
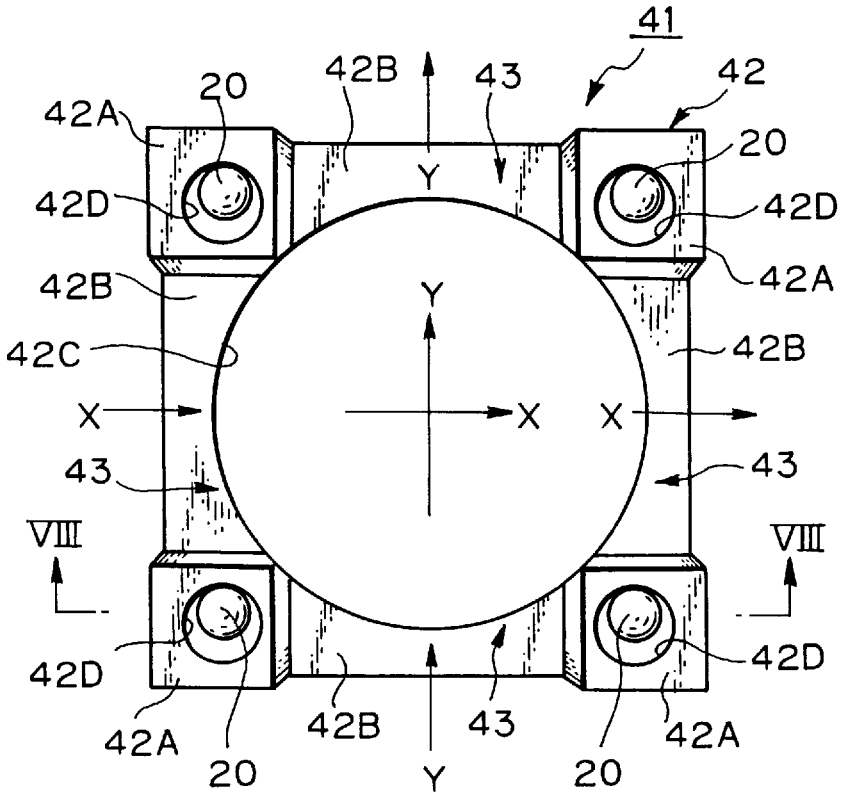
FIG. 7 is a plan view similar to FIG. 3, but showing a third embodiment of the present invention.
Figure 8:
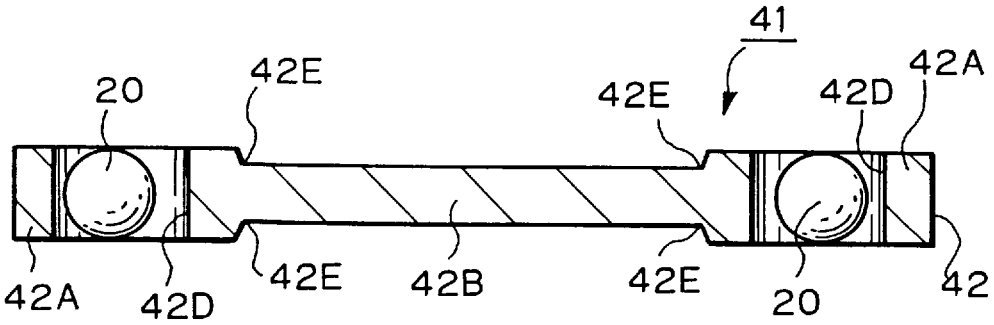
FIG. 8 is an enlarged sectional view taken along the line VIII—VIII in FIG. 7.

Next, a third embodiment of the present invention will be explained with reference to FIGS. 7 and 8. In this third embodiment, the same elements as those in the first embodiment are designated by the same reference numerals, and explanation thereof will be omitted. Incidentally, the feature of the third embodiment is that a slider 42 of a rotation preventing mechanism 41 is constituted by square thick portions 42A and thin portions 42B interconnecting the thick portions, and a circular opening 42C is defined at a central portion of the slider 42.

Similar to the slider 32 of the second embodiment, the slider 42 is constituted by the thick portions 42A and the thin portions 42B, and balls 20 are contained within through holes 42D formed in the thick portions. At front and rear sides of the thin portions 42B, passage portions 43 are defined between inclination surfaces 42E. However, the slider 42 has the large central circular opening 42C in place of the square opening.

Thus, also in this third embodiment, the technical advantage substantially the same as that of the second embodiment can be obtained. Particularly, in the third embodiment, since the slider 42 has the large central circular opening 42C, a portion of the cooling air flowing in the X-axis and Y-axis directions can be introduced between the large central circular opening 42C of the slider 42 and the boss portion 14A of the rear plate 14, thereby improving the cooling efficiency.

Next, a fourth embodiment of the present invention will be explained with reference to FIGS. 9 to 11. In this fourth embodiment, the same elements as those in the first embodiment are designated by the same reference numerals, and explanation thereof will be omitted. Incidentally, the feature of the fourth embodiment is that a rotation preventing mechanism 51 is constituted by a slider 52, X-axis and Y-axis keys 53A, 53B integrally formed with the slider 52 and adapted to regulate or limit the sliding movement of the slider 52 between the casing 1 and the orbiting scroll member 9 to two (X-axis and Y-axis) directions, X-axis key ways 54A and Y-axis key ways (not shown) for receiving the X-axis and Y-axis keys 53A, 53B, respectively, and balls 20.

Figure 10:
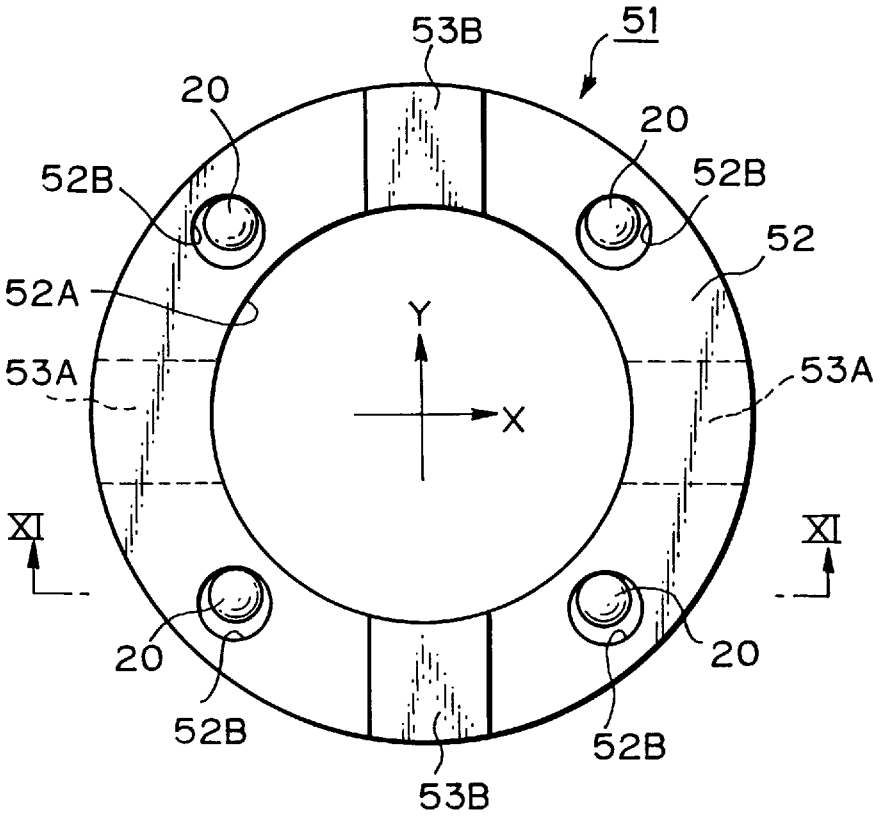
FIG. 10 is an enlarged plan view of the slider and balls shown in FIG. 9.
Figure 11:
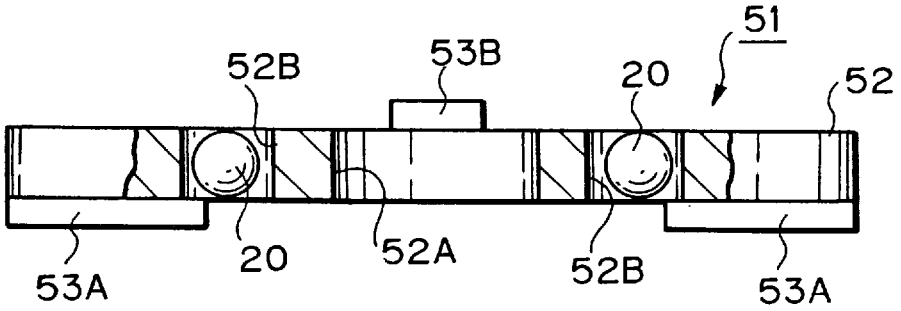
FIG. 11 is an enlarged sectional view taken along the line XI—XI in FIG. 10.

Although the slider 52 is formed substantially similar to the slider 19 of the first embodiment, as shown in FIG. 10, the slider 52 is formed from a circular plate member, and a circular central opening 52A is formed in the circular plate member and through holes 52B for receiving the balls 20 are formed in the circular plate member along its circumferential direction. As shown in FIGS. 10 and 11, the pair of X-axis keys 53A are formed on the rear surface of the slider 52 along the X-axis direction and the pair of Y-axis keys 53B are formed on the front surface of the slider 52 along the Y-axis direction.

Figure 9:
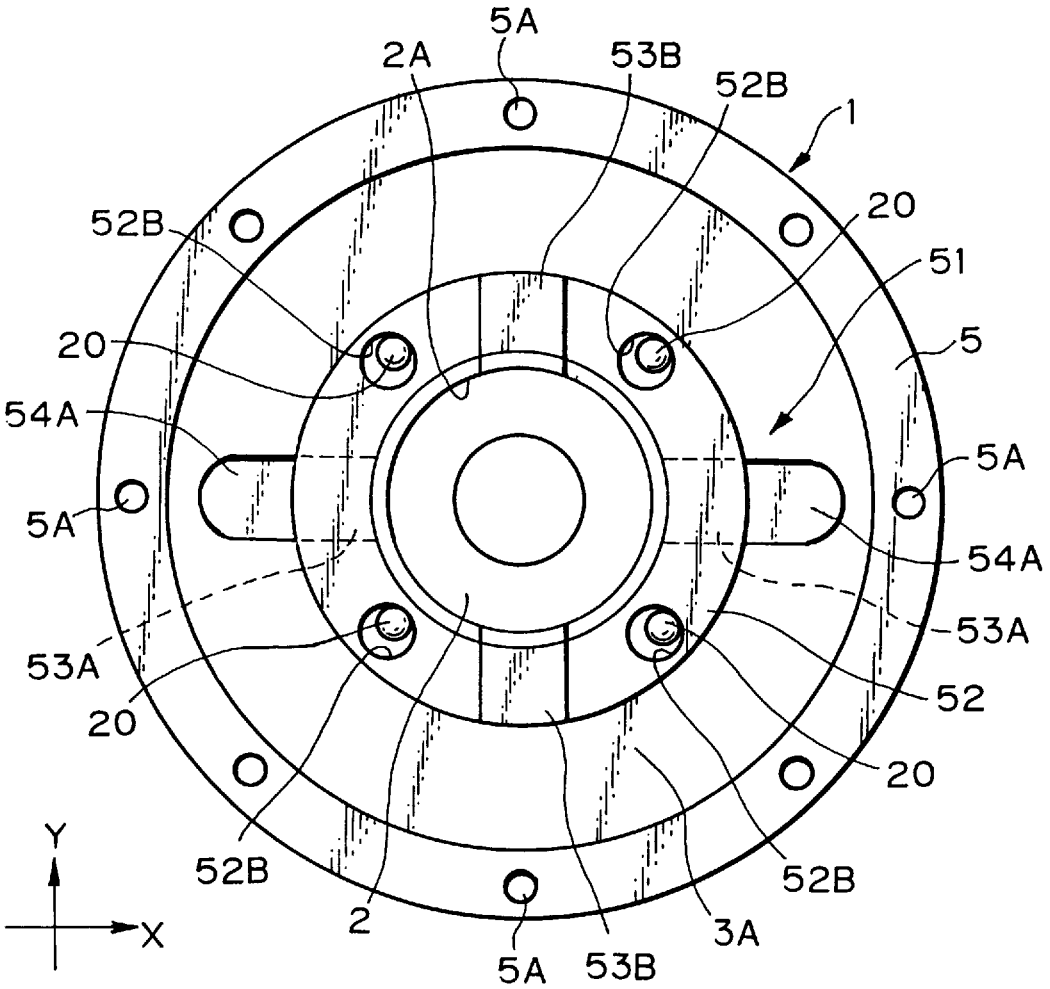
FIG. 9 is a view showing a condition that a slider of a scroll-type air compressor according to a fourth embodiment of the present invention is disposed within a casing.

On the other hand, as shown in FIG. 9, the X-axis key ways 54A corresponding or conforming to the X-axis keys 53A are formed in the slide surface 3A of the flange portion 3 of the casing 1, and the Y-axis key ways conforming to the Y-axis keys 53B are formed in the slide surface 14B of the rear plate 14.

By sliding the X-axis keys 53A of the slider 52 in the key ways 54A of the slide surface 3A, respectively, the slider 52 is prevented from sliding in the Y-axis direction with respect to the slide surface 3A. Similarly, by sliding the Y-axis keys 53B of the slider 52 in the key ways of the slide surface 14B, respectively, the slider 52 is prevented from sliding in the X-axis direction with respect to the orbiting scroll member 9.

Thus, also in this fourth embodiment, the slider 52 an slide on the slide surfaces 3A, 14B while rolling the balls 20 on the slide surfaces 3A, 14B, thereby obtaining substantially the same technical advantage as that of the first embodiment.

Figure 12:
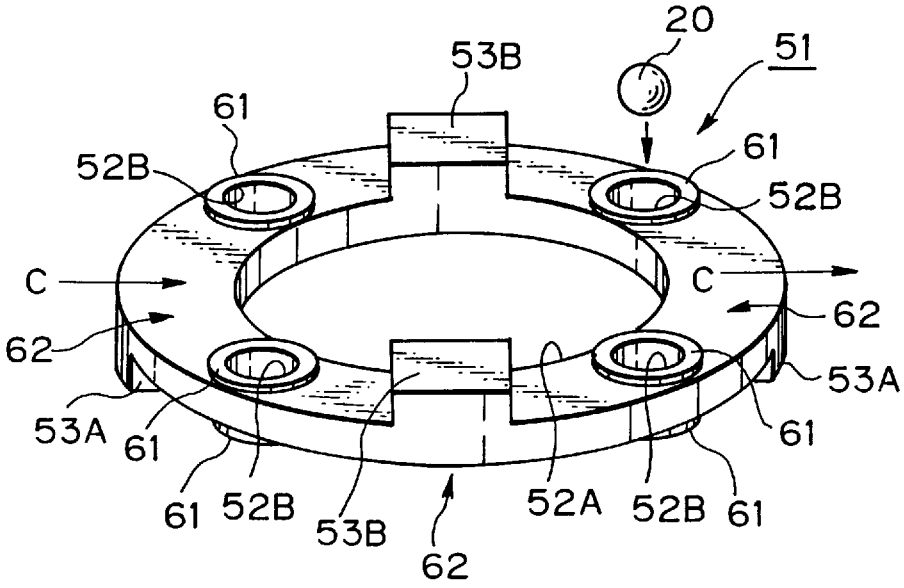
FIG. 12 is an exploded perspective view showing a slider and balls according to a fifth embodiment of the present invention.

Next, a fifth embodiment of the present invention will be explained with reference to FIG. 12. In this fifth embodiment, the same elements as those in the fourth embodiment are designated by the same reference numerals, and explanation thereof will be omitted. Incidentally, the feature of the fifth embodiment is that annular protrusions 61 encircling the through holes 52B are formed on the front and rear surfaces of the slider 52 so that end (upper and lower) surfaces of the annular protrusions 61 act as slide surfaces associated with the slide surface 3A of the flange portion 3 and the slide surface 14B of the rear plate 14 and passage portions 62 for passing the cooling air are defined between the slider 62 and the slide surfaces 3A, 14B by the presence of the annular protrusions 61.

Thus, also in this fifth embodiment, the cooling air can be introduced toward directions C and the like, thereby obtaining substantially the same technical advantage as that of the second embodiment.

Figure 13:
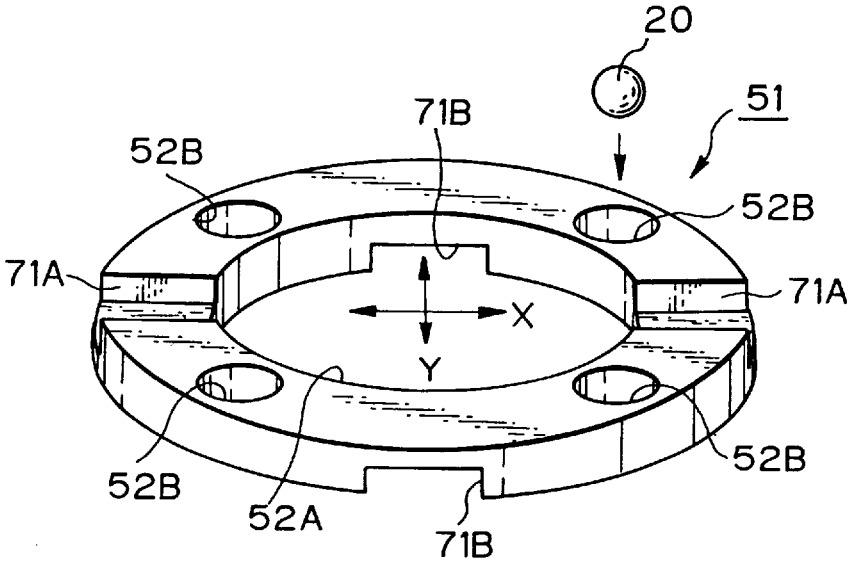
FIG. 13 is a perspective view similar to FIG. 12, but showing a sixth embodiment of the present invention.

Next, a sixth embodiment of the present invention will be explained with reference to FIG. 13. In this sixth embodiment, the same elements as those in the fourth embodiment are designated by the same reference numerals, and explanation thereof will be omitted. Incidentally, the feature of the sixth embodiment is that, in place of the X-axis and Y-axis keys 53A, 53B of the fourth embodiment, X-axis key ways 71A and Y-axis key ways 71B are formed in the front and rear surfaces of the slider 52, respectively, and X-axis and Y-axis keys (not shown) corresponding to the key ways 71A, 71B are formed on the slide surface 3A of the flange portion 3 and the slide surface 14B of the rear plate 14, respectively.

Thus, also in this sixth embodiment, the slider 52 of the rotation preventing mechanism 51 can slide between the casing 1 and the rear surface of the orbiting scroll member 9 while rolling the balls 20 therebetween, thereby obtaining substantially the same technical advantage as that of the first embodiment.

Figure 14:
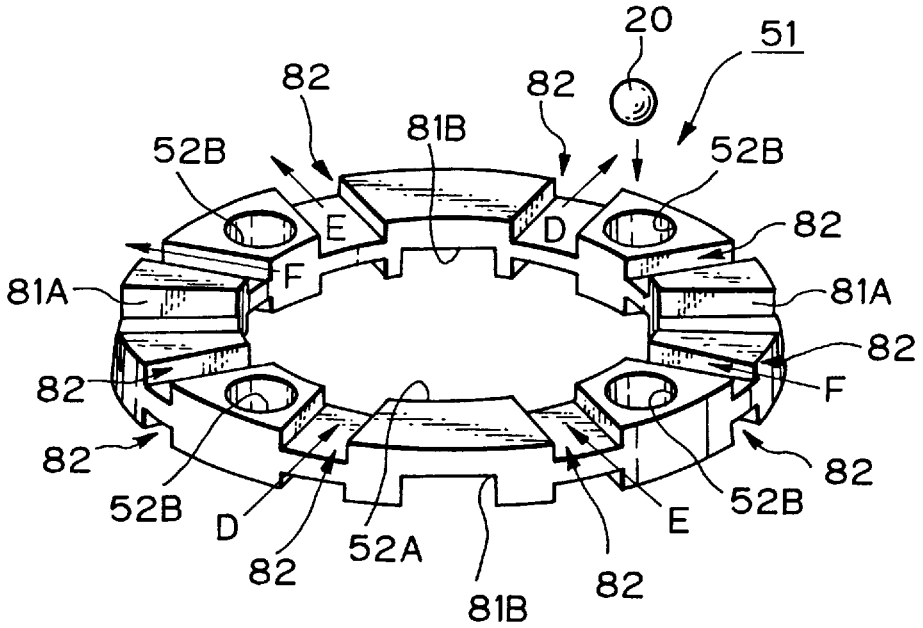
FIG. 14 is a perspective view similar to FIG. 12, but showing a seventh embodiment of the present invention.

Lastly, a seventh embodiment of the present invention will be explained with reference to FIG. 14. In this seventh embodiment, the same elements as those in the fourth embodiment are designated by the same reference numerals, and explanation thereof will be omitted. Incidentally, the feature of the seventh embodiment is that X-axis key ways 81A and Y-axis key ways 81B are formed in the front and rear surfaces of the slider 52, respectively, and a plurality of passage portions 82 formed in the surfaces of the slider and spaced apart from each other in the circumferential direction are disposed between the key ways 81A, 81B and the through holes 52B so that the cooling air can pass through the slider 52 via the passage portions 82 in the directions D, E, F, for example.

Also in this seventh embodiment, substantially the same technical advantage as that of the fifth embodiment can be obtained.

In the above-mentioned embodiments, while an example that four through holes 19B (32D, 42D, 52D) are formed in the slider 19 (32, 42, 52) was explained, the present invention is not limited to such an example, but, for instance, five or more through holes may be provided in a spaced relation in the circumferential direction of the orbiting scroll member 9, or three through holes may be provided. When five or more through holes are provided, the slider 19 (32, 42, 52) can be slid more smoothly with respect to the slide surfaces 3A, 14B; the wear and damage of the slider 19 (32, 42, 52) can surely be prevented; and an external force acting on each ball 20 can be reduced, thereby improving the endurance of the balls 20 effectively.

In the above-mentioned embodiments, while an example that the through holes are filled with the grease to increase the lubrication ability for the balls 20 was explained, in place of this, the balls 20 and the slider 19 (32, 42, 52) may be formed from self-lubricating material to increase the lubrication ability for the balls 20, or the entire balls are formed from ceramic material to realize an oil free feature, or outer layers of the balls alone are formed from ceramic material to realize an oil free feature.

Further, in the above-mentioned embodiments, while an example that the scroll-type air compressor is embodied as the scroll-type fluidic machine was explained, the present invention is not limited to such an example, but may be applied to a vacuum pump, a refrigerant compressor or the like.

What is claimed is:

1. A scroll-type fluidic machine comprising a casing, a fixed scroll member integrally mounted on said casing, a drive shaft rotatably supported by said casing and having one end formed as a crank, an orbiting scroll member rotatably attached to said crank of said drive shaft so that a plurality of compression chambers are defined between said orbiting scroll member and said fixed scroll member, and a rotation preventing mechanism for preventing rotation of said orbiting scroll member, wherein said rotation preventing mechanism comprises;

a slider disposed between said casing and said orbiting scroll member and slidable in two directions perpendicular to each other, relative to said casing and said orbiting scroll member, respectively, said slider having a generally rectangular configuration having a first pair of opposite side surfaces and a second pair of opposite side surfaces;

guide members formed on said casing for guiding said slider in one of said two directions by sliding engagement with said slider in one of said two directions by sliding engagement with said first pair of opposite side surfaces of said slider;

guide members formed on said orbiting scroll member for guiding said orbiting scroll member for movement relative to said slider in the other of said two directions by sliding engagement with said second pair of opposite side surfaces of the slider; and said slider having a central opening for allowing connection between said orbiting scroll member and said drive shaft and including a plurality of thick portions spaced from each other in the circumferential direction of said orbiting scroll member and thin portions therebetween for forming cooling air passages which extend from outside of said slider to said central opening.

2. A scroll-type fluidic machine according to claim 1, wherein at least one of said thick portions has a through hole receiving a rolling element.

3. A scroll-type fluidic machine according to claim 1, wherein said slider has four corner portions and said thick portions are positioned in said four corners.

4. A scroll-type fluidic machine according to claim 3, wherein each said thick portion has a through hole receiving a rolling element.

* * * * *